United States Patent [19]

Yoshimura et al.

[11] Patent Number: 4,701,388

[45] Date of Patent: Oct. 20, 1987

[54] INSTANT FILM UNIT WITH COLORING MEANS

[75] Inventors: Kazuyuki Yoshimura; Yoshio Sakakibara, both of Kanagawa, Japan

[73] Assignee: Fuji Photo Film Co., Ltd., Kanagawa, Japan

[21] Appl. No.: 884,302

[22] Filed: Jul. 10, 1986

[30] Foreign Application Priority Data

Jul. 10, 1985 [JP] Japan ..... 60-105383[U]

[51] Int. Cl.[4] ..... G03C 5/54; G03C 3/00

[52] U.S. Cl. ..... 430/209; 430/207; 430/221; 354/304

[58] Field of Search ..... 430/207, 209, 221; 354/304

[56] References Cited

U.S. PATENT DOCUMENTS 3,320,065 5/1967 Campbell ..... 430/209

3,689,269 9/1972 Schieven ..... 430/209

*Primary Examiner*—Richard L. Schilling

*Attorney, Agent, or Firm*—Young & Thompson

[57] ABSTRACT

A peel-apart instant film unit including two separate sheets comprising a photosensitive sheet and an image-receiving sheet, has a coloring member provided on one end of the photosensitive sheet so as to contact a developer reagent spread between the two sheets for processing. The coloring member is adapted to change in color upon the completion of the processing of the film unit as a result of the chemical reaction of the coloring member brought into contact with the developer reagent. The color change of the coloring member, which is observed from the outside of the film unit, indicates the completion of the processing of the film unit. The coloring member includes a time delay substance that initially separates the reagent spread between the sheets, from the substance that changes color. That time delay substance is permeable by the reagent at a rate such that the reagent reaches that substance and causes the color change only upon the completion of the development of the film unit.

5 Claims, 4 Drawing Figures

INSTANT FILM UNIT WITH COLORING MEANS

BACKGROUND OF THE INVENTION

The present invention relates to a peel-apart instant film unit.

In peel-apart instant films (which are, hereinafter, referred to as film units for simplicity), two separate diffusion transfer sheets are used: a negative or photosensitive sheet in which a latent image is created as a result of exposure and a positive or image-receiving sheet where the positive image is formed. Sheets of negative and positive material are arranged separately in packs in such a way that the negative can be exposed, and then the two sheets can be pressed emulsion-to-emulsion when they are withdrawn from a camera or film holder. As the sheets emerge from the camera or film holder, they pass between two pressure-applying rollers which break a pod of viscous processing liquid or developer reagent and spread it uniformly between the two emulsions. When the two sheets are peeled away from each other upon the completion of processing a positive transfer image is formed in the image receiving sheet.

For this processing, the two sheets are interconnected to each other by means of a withdrawing sheet member and a mask member, and these sheets and members constitute a film unit as a whole.

The film unit is provided with a pod, mentioned above, which is ruptured to release the developer reagent contained therein when the film unit passes between the pressure rollers, and a flap connected to the trailing end of the negative sheet for forming trap means which receives excess developer reagent. In the film unit, there is also a funnel member for directing the released developer reagent from the ruptured pod between the two sheets.

In this type of peel-apart instant film unit, there is the disadvantage that it is impossible to observe the progress of the development of a positive image, since the two sheets are maintained superimposed emulsion-to-emulsion during processing. In this regard, the peel-apart instant film unit lacks the advantage of an integral type of instant film unit well known in the art in which the progress of development of a positive image is visible from the outside even during processing of the film unit. The fact that, in the peel-apart instant film, the developing positive image is invisible forces the user to peel apart the two sheets only after a period of time which is specifically indicated by the manufacturer of the film unit in order to ensure the completion of processing.

A film unit heretofore used has several disadvantages which make it difficult to implement the film unit in a practical environment. In particular, the conventional film unit may experience difficulties in forming the best positive image. In practice, because of the dependence of photographic processing on ambient temperatures, the film units are not able to provide the best positive images when they are subject to a predetermined processing period of time. For example, since photographic development proceeds slowly at fairly low ambient temperatures, the film unit is is insufficiently processed, resulting in a low quality of positive image. Conversely, specifying a processing time longer than that usually required, in consideration of the above problem, there will be a loss of time when the film unit is processed at an ambient temperature approximately equal to or higher than a normal processing temperature.

OBJECT OF THE INVENTION

It is, therefore, an object of the present invention to overcome these and other disadvantages of the prior peel-apart instant film units and to provide a peel-apart instant film unit which is able to give an indication of the completion of processing in order to make a print of the best positive image.

It is another object of the present invention to provide a peel-apart instant film unit which does not require unnecessary waiting time after the completion of processing.

SUMMARY OF THE INVENTION

In accordance with the invention, there is provided coloring means in a peel-apart instant film unit comprising two separate sheets, namely a negative or photosensitive sheet and a positive or image-receiving sheet, which are coupled to each other through a withdrawing sheet member which has a rupturable pod containing a processing liquid or developer reagent attached thereto. The color means can be located either on the processing liquid passage formed adjacent the leading end of the photosensitive sheet by a funnel, or on the withdrawing sheet member, or else on the excess liquid trapping means formed beyond the trailing end of the photosensitive sheet by a flap member, so as to contact and react with the processing liquid released from the pod. The coloring means is adapted to change in color, as a result of the contact reaction with the processing liquid, upon completion of the processing of the film unit. The color change of the coloring means, which can be visually observed with ease, indicates the completion of the processing of the film unit.

In a preferred embodiment of this invention, the coloring means is provided as a multilayer coating including a timing layer for controlling the timing of color change, and a coloring mordant layer for producing or fixing coloring dye as a result of its contact with processing liquid. In the case of providing the coloring means on the flap member forming the excess liquid trapping means, it is desirable to omit a part of the sealing layer applied over the flap member for adhering it to the photosensitive sheet in order to make it easy to observe color change through the omitted part of the sealing layer.

BRIEF DESCRIPTION OF THE DRAWINGS

For a better understanding of the present invention, together with other and further objects, reference is made to the following description, taken in conjunction with the accompanying drawings, in which.

DETAILED DESCRIPTION OF THE INVENTION

Figure 1:
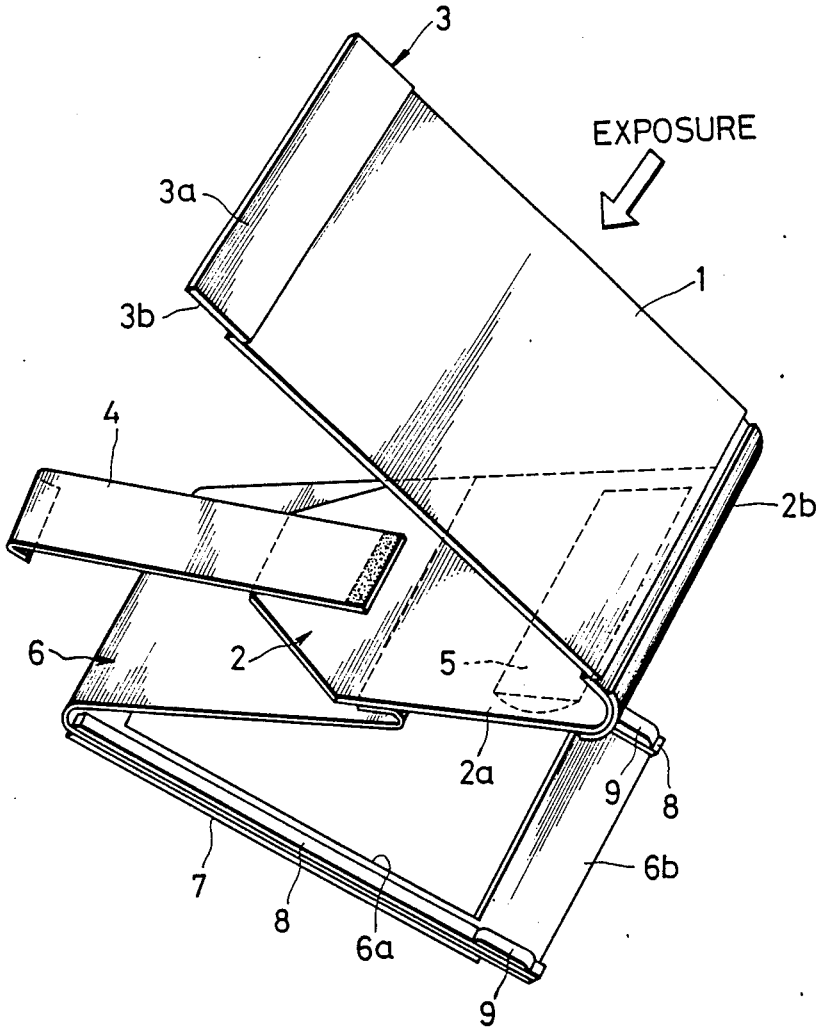
FIG. 1 is a perspective view of a peel-apart instant film unit in accordance with an embodiment of this invention.

Referring to FIG. 1 showing the peel-apart instant film unit of an embodiment in accordance with the present invention, the negative and positive sections of the peel-apart instant film unit (hereinafter referred to as the film unit) are on separate sheets: a negative or photosensitive, and a positive or image-receiving sheet. In the photosensitive sheet 1, exposure creates a latent image. Connected to the photosensitive sheet 1 are a withdrawing sheet member 2 at its front margin (at the right hand side of the photosensitive sheet 1 in FIG. 1) and a flap member 3 at its rear margin. The withdrawing sheet member 2 is provided with a rectangular tab 4 detachably connected thereto near its front section. The withdrawing sheet member 2 is further provided on its rear portion 2*a* with a rupturable pod 5 containing a processing liquid or viscous developer reagent therein as well as a funnel member 2*b* which is adapted to cooperate with the rear portion 2*a* of the withdrawing sheet member 2 so as to form a passage for the developer reagent released from the pod 5 for preventing it from escaping from the sides of the film unit.

A mask member 6, which is connected to the withdrawing sheet member 2 at its front end, is formed with an aperture 6*a* for defining an image area on the image-receiving sheet 7 which is attached to the back of the mask member 6 in such a way as to cover the aperture 6*a*. Along each side of the aperture 6*a*, the mask member 6 is provided with a predetermined thickness of rail member 8 adhered thereto which serves as a spacer for effecting a uniform distribution of developer reagent. The mask member 6 at its rear end has a flap 6*b* which is adapted to face the rear flap member 3 at the end of the withdrawal of the film unit between a pair of pressure applying rollers. To each rail member 8 on the rear flap 6*b* a spacer chip 9 is adhered to provide a trapping space.

All of the members 2, 3, 9, which are made of paper sheet materials, are adhered to the photosensitive and/or image-receiving sheets, 1, 7 through sealing material.

Figure 2:
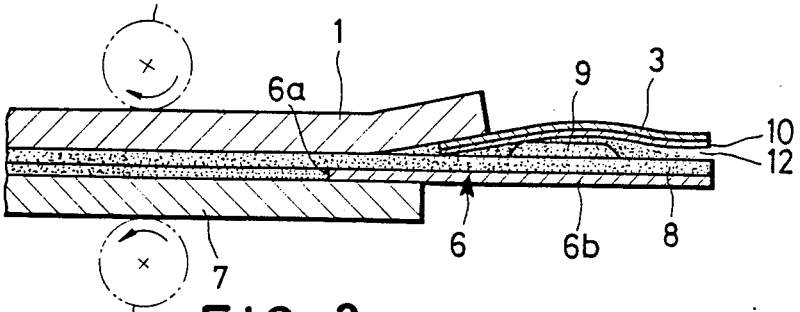
FIG. 2 is a cross sectional view of a principal part of the film unit of FIG. 1.
Figure 3:
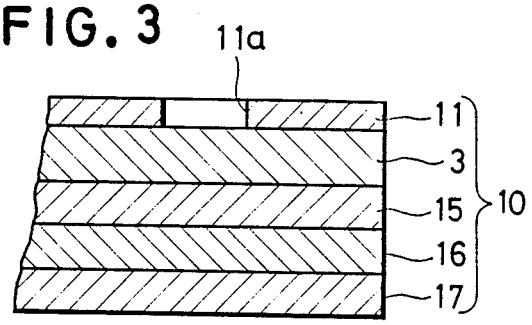
FIG. 3 is an explanatory, cross sectional view of the coloring layer.

The rear flap member 3, as shown in FIGS. 2 and 3, has a coloring layer 10 coated on its surface 3*a* and a sealing material layer 11 on the other surface 3*b* through which it is adhered to the photosensitive sheet 1.

The film unit thus constructed is, after exposure, withdrawn form a camera or film holder. At this time, the two sheets 1, 7 pass between a pair of juxtaposed pressure-applying rollers 18, thereby to be superimposed emulsion-to-emulsion and to break the pod 5 so as to release the viscous developer reagent and spread it between the two superimposed sheets 1, 7 after having passed through the passage formed by the rear portion 2*a* of the withdrawing member 2 and the funnel member 2*b*. The developer reagent thus spread between the two superimposed sheets 1, 7 is kept uniform in thickness by the aid of the spacer rails 8, so as to avoid unevenness in development over the image area.

As shown in FIG. 2, when the two sheets 1, 7 are withdrawn between the pressure-applying rollers 18, excess developer reagent 12 is forced toward the rear end of the film unit and stays in a trapping space formed by the rear flap 6*b* of the mask member 6, the rear flap member 3 and the spacer chips 9. Consequently, the excess developer reagent 12 trapped in the space is brought into contact with the coloring layer 10 coated on the surface 3*a* of the rear flap member 3.

As shown in FIG. 3, the coloring layer 10 consists of three layers; a mordant layer 15, a white color layer 16 and a timing layer 17, all the layers being coated on the rear flap member 3, in that order from the surface 3*a* thereof. In FIG. 3, it will be seen that the sealing material layer 11 has a partial omission 11a.

The developer reagent 12 in the trapping space permeates gradually through the timing layer 17 into the layers 16 and 15. At this time, the timing layer 17 is made to react with the developer reagent which is alkaline, controlling the progress of chemical reaction of the developer reagent with the mordant layer 15. The white layer 16 is provided to make it easy to observe the coloration of the mordant layer 15 from the top side of the three layers in FIG. 3. The mordant material layer 15 consists of a colorless coloring reaction layer which reacts with the developer reagent 12 permeating thereinto through the timing and the white color layers 17, 16, to change to the color blue when the reaction proceeds to a predetermined extent, and a mordanting layer for the fixation of the blue colored dye. The above-mentioned color change takes place in accordance with the compositions of the three layers 15, 16, 17, which will be tabulated later.

Figure 4:
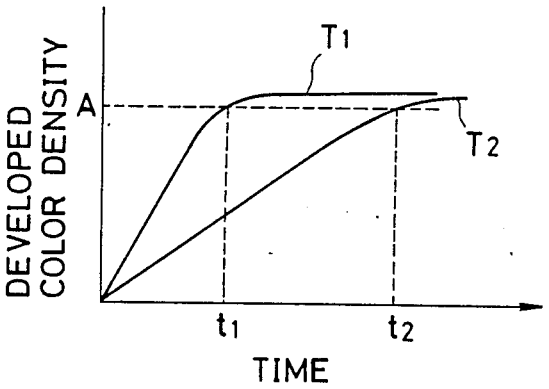
FIG. 4 is a graph showing a developed color density-ambient temperature relationship of a coloring layer.

Because it is a chemical reaction, the abovedescribed coloring reaction depends on ambient temperature as is shown in FIG. 4. In the illustrative example, a developed color density A which is enough to observe visibly a color change is reached at time t2 at a temperature T2 lower than normal temperatures, whereas the same color density is reached at time t1 at a normal temperature T1. As is apparent from the foregoing, this coloring reaction takes place simultaneously with the diffusion transfer process of the film unit just after the developer reagent has been distributed between the two superimposed sheets 1,7. It is to be noted that the coloring reaction period of the coloring layer 10, needed for a visibly observable color change, depends on the proportions of the chemical composition of the timing layer 17 and the ambient temperature at the time of reaction. This makes it possible to adapt the time t1 required for the predetermined, developed color density A at, for example, a normal ambient temperature T1 to the time for the completion of the diffusion transfer process in the film unit, by changing the proportions of the chemical composition of the timing layer 17 and by making the temperature dependence of the chemical reaction the same between the coloring layer 10 and the developer reagent. This adaptation of time gives a precise indication that the diffusion transfer process is complete upon the occurrence of a color change in the coloring layer 10 which is observed through the partial omission 11*a* of the sealing layer 11.

For easy observation of the color change, it is desirable that the rear flap member 3 be highly light transmissive. As a material for the rear flap member 3, PET (polyethylene-terephthalate) is preferred from the point of view of strength. An opaque black layer is used as the sealing layer 11 for ensuring the shading ability of the layer 11. This is the reason why the sealing layer 11 is provided with the partial omission 11*a*. For manufacturing convenience, it is desirable to coat the mordant layer 15 and the white layer 16 as a single layer.

The following table shows an example of the chemical composition and coating thickness and quantity of each layer of the coloring layer 10.

| White Layer | Total Thickness 3μ |
|---|---|
| Gel (Desalted Gelatin) | 100 g |
| $H_2O$ | 300 ml |
| EtOH (Ethanol) | 700 ml |

-continued

| | |
|---|---|
| Salicylic Acid | 1 g |
| NaOH (10%) | 16 ml |
| TWG (Titanium White Emulsion) | 327 g |
| Hardening Agent (2%) | 200 ml |
| Mordant Layer | Thickness 3μ |
| Gel (Desalted Gelatin) | 100 g |
| $H_2O$ | 300 mg |
| EtOH | 700 mg |
| Salicylic Acid | 1 g |
| NaOH (10%) | 16 mg |
| Mordant Agent (EM-25) | 100 g |
| Hardening Agent (2%) | 200 mg |
| TP (Thymol Phthalein) | 1.0 g |
| Timing Layer | Total Quantity 2.1 g/m$^2$ |
| DAC (Diacetylcellulose) | 60 g |
| MEK (Methylethyl Ketone: 70%)/ EtOH (8%)/1000 ml $H_2O$ (10%) | 1000 ml |
| Acid Polymer | 56 g |
| Black Dye | 8 g |

The timing layer has the advantage that it is possible to adjust the reaction period required by the coloring reaction layer. Specifically, this adjustment can be effected by changing the amount of the DAC contained in the timing layer. The acid polymer is contained as a stabilizer to change with the passage of time in the timing layer.

Although the coloring layer 10 is, in the above-described embodiment, applied to a part of the rear flap member 3 forming the excess developer reagent trapping space, it is permissible to apply the coloring layer 10 to a part of the passage for the developer reagent. Specifically, the coloring layer 10 can be applied either to the funnel member 2*b* or to the withdrawing member 2 at its rear portion 2*a*. In this case, the color change in the coloring layer 10 can be observed either through the semi-transparent mask member 6 or through the withdrawing member 2 in the same way as in the above-described embodiment. As a coloring reaction chemical material contained in the mordant layer, although a colorless TP which changes to the color blue upon reaction with the developer reagent is used for the observation of the completed development of the film unit, many other coloring materials such as thymol blue, a phenolphthalein, alizarin yellow, indigo carmine, etc. can be used.

It is also permissible to attach a sheet member which is provided with the above-described coloring layer painted or coated therein to an appropriate part of either the passage or the trapping space.

The invention has been described with particular reference to preferred illustrative embodiments thereof, but it will be understood that variations and modifications can be effected within the spirit and scope of the invention.

What is claimed is:

1. A peel-apart instant film unit including two separate sheets comprising a photosensitive sheet and an image-receiving sheet, and means coupling said two separate sheets to each other and having a rupturable pod containing therein a developer reagent, said coupling means being adapted to superimpose said two separate sheets when said coupling means is withdrawn from a camera or film holder so as to spread the developer reagent released from said pod between said two sheets, said film unit comprising:

means attached to said coupling means for forming a passage in cooperation with said coupling means, said passage being adapted to direct said developer reagent released from said pod between said two sheets;

means attached to said photosensitive sheet at its rear end for forming a trapping space which collects an excess of said developer reagent therein; and coloring means provided on one of said passage forming means and said trapping space forming means and adapted to change in color upon contact with said developer reagent, said color change giving a visible indication of the time of completion of the development of said film unit.

2. A peel-apart instant film unit as defined in claim 1, wherein said coloring means is a layer of chemical material.

3. A peel-apart instant film unit as defined in claim 1, wherein said trapping space forming means is a flap member coupled to said photosensitive sheet and said coloring layer is coated on said flap member.

4. A peel-apart instant film unit as defined in claim 1, wherein said trapping space forming means is a flap member which is coated with a sealing layer on one side for coupling said flap member to said photosensitive sheet and is provided with said coloring means on the other side, said sealing layer being opaque but having a part omitted through which said color change is observed.

5. A peel-apart instant film unit as defined in claim 1, wherein said coloring means includes a substance that changes color upon contact with said developer reagent, and means separating said substance from said developer reagent when said developer reagent is first spread between said sheets, said separating means being permeable by said developer reagent at a rate such that said developer reagent reaches said substance and causes said color change only upon the completion of the development of said film unit.

* * * * *